US010327074B2

(12) United States Patent
Wang et al.

(10) Patent No.: US 10,327,074 B2
(45) Date of Patent: Jun. 18, 2019

(54) VIBRATING FILM AND VIBRATING FILM ASSEMBLING PROCESS

(71) Applicant: GOERTEK INC., WeiFang, Shandong (CN)

(72) Inventors: Hui Wang, WeiFang (CN); Xiang Guo, WeiFang (CN)

(73) Assignee: GOERTEK, INC., Weifang, Shandong (CN)

( * ) Notice: Subject to any disclaimer, the term of this patent is extended or adjusted under 35 U.S.C. 154(b) by 0 days.

(21) Appl. No.: 15/566,314

(22) PCT Filed: Nov. 18, 2015

(86) PCT No.: PCT/CN2015/094896
§ 371 (c)(1),
(2) Date: Oct. 13, 2017

(87) PCT Pub. No.: WO2016/165324
PCT Pub. Date: Oct. 20, 2016

(65) Prior Publication Data

US 2018/0160230 A1 Jun. 7, 2018

(30) Foreign Application Priority Data

Apr. 14, 2015 (CN) ..... 2015 1 0175881

(51) Int. Cl.
*H04R 7/10* (2006.01)
*H04R 7/04* (2006.01)
(Continued)

(52) U.S. Cl.
CPC ..... *H04R 7/10* (2013.01); *H04R 7/045* (2013.01); *H04R 7/127* (2013.01); *H04R 7/18* (2013.01);
(Continued)

(58) Field of Classification Search
CPC ..... H04R 7/10; H04R 7/125; H04R 7/127; H04R 31/003; H04R 2231/001; H04R 7/04
See application file for complete search history.

(56) References Cited

U.S. PATENT DOCUMENTS 4,410,768 A * 10/1983 Nakamura ..... H04R 7/02 181/167
2002/0195901 A1* 12/2002 Takeshima ..... H04R 17/00 310/324
(Continued)

FOREIGN PATENT DOCUMENTS

CN 202269011 U 6/2012
CN 202488695 U 10/2012
(Continued)

OTHER PUBLICATIONS

International Search Report, State Intellectual Property Office of the Peoples Republic of China, dated Dec. 27, 2015.
(Continued)

*Primary Examiner* — Joshua Kaufman
(74) *Attorney, Agent, or Firm* — Holzer Patel Drennan

(57) ABSTRACT

Disclosed is a vibrating film comprising a vibrating film body, wherein the vibrating film body comprises a central plane part and a peripheral fixing part. A Dome reinforcing part is arranged on the plane part, a first thermosetting adhesive layer is provided between the plane part and the Dome reinforcing part, and the plane part and the Dome reinforcing part are adhered together by thermosetting through the first thermosetting adhesive layer. Further disclosed is an assembling process for the vibrating film.

8 Claims, 4 Drawing Sheets

(51) Int. Cl.

| | |
|---|---|
| ***H04R 7/12*** | (2006.01) |
| ***H04R 31/00*** | (2006.01) |
| ***H04R 7/18*** | (2006.01) |

(52) U.S. Cl.
CPC ..... *H04R 31/003* (2013.01); *H04R 2231/001* (2013.01); *H04R 2231/003* (2013.01); *H04R 2307/204* (2013.01)

(56) References Cited

U.S. PATENT DOCUMENTS

| | | | | |
|---|---|---|---|---|
| 2003/0190051 | A1 | 10/2003 | Williamson | |
| 2004/0170298 | A1* | 9/2004 | Ohta | H04R 1/02 381/433 |
| 2016/0165351 | A1* | 6/2016 | Shao | H04R 7/10 381/398 |

FOREIGN PATENT DOCUMENTS

| | | | |
|---|---|---|---|
| CN | 103209376 | A | 7/2013 |
| CN | 103686547 | A | 3/2014 |
| CN | 103686548 | A | 3/2014 |
| CN | 104811869 | A | 7/2015 |
| CN | 204498357 | U | 7/2015 |
| WO | 2014079376 | A1 | 5/2014 |

OTHER PUBLICATIONS

Second Office Action, Chinese Application No. 201510175881.5, State Intellectual Property Office of the P.R. of China, dated Mar. 21, 2018.

* cited by examiner

VIBRATING FILM AND VIBRATING FILM ASSEMBLING PROCESS

TECHNICAL FIELD

The present invention relates to the technical field of electro-acoustic products, and more particularly, to a vibrating diaphragm and an assembling process for the vibrating diaphragm.

BACKGROUND

A vibrating diaphragm is one of the main components of electro-acoustic products. A typical vibrating diaphragm comprises a vibrating diaphragm body, a fixing steel ring is arranged at the periphery of the vibrating diaphragm body, and a Dome reinforcing part is provided at the central plane part of the vibrating diaphragm body. In the existing vibrating diaphragm structure, the vibrating diaphragm body and the Dome reinforcing part, as well as the vibrating diaphragm body and the fixing steel ring are mostly bonded by adhesive. This adhesive technology has lower adhesive force, thus, after the vibrating diaphragm is arranged into electro-acoustic products, the vibrating diaphragm tends to loose in the subsequent application of electro-acoustic products, which has been unable to meet the current requirements on high-power electro-acoustic products. In addition, during the production process of the vibrating diaphragm using the existing technology, the vibrating diaphragm, the fixing ring and the Dome reinforcing part are required to be bonded respectively, and thus the production efficiency is lower.

SUMMARY

The first technical problem sought to be solved by the present invention is to provide a vibrating diaphragm having strong adhesion strength between components and good high-frequency characteristic.

The second technical problem sought to be solved by the present invention is to provide an assembling process for the vibrating diaphragm having strong adhesion strength between components and good high-frequency characteristic.

In order to solve the first technical problem mentioned above, a technical solution of the present invention is that:

a vibrating diaphragm, comprising a vibrating diaphragm body, wherein the vibrating diaphragm body comprises a plane part at a central portion and a fixing part at a peripheral portion, a Dome reinforcing part is provided on the plane part, a first thermosetting adhesive layer is provided between the plane part and the Dome reinforcing part, and the plane part and the Dome reinforcing part are adhered together by thermally curing the first thermosetting adhesive layer.

Preferably, a fixing ring is provided on the fixing part, a second thermosetting adhesive layer is provided between the fixing part and the fixing ring, and the fixing part and the fixing ring are adhered together by thermally curing the second thermosetting adhesive layer.

Preferably, each of the first thermosetting adhesive layer and the second thermosetting adhesive layer is a thermosetting adhesive pad.

Preferably, the thermosetting adhesive pad is a thermosetting adhesive pad made of epoxy resin material or polyimide resin material.

Preferably, the fixing ring is a fixing ring made of metal material.

Preferably, the fixing ring is a fixing ring made of steel or copper material.

In order to solve the second technical problem mentioned above, a technical solution of the present invention is that:

an assembling process for the above-mentioned vibrating diaphragm, comprising the following steps:

step (a): preparing a molding base for the vibrating diaphragm, and providing the Dome reinforcing part on the molding base for the vibrating diaphragm;

step (b): providing the first thermosetting adhesive layer on the Dome reinforcing part;

step (c): providing a material belt of the vibrating diaphragm above the Dome reinforcing part;

step (d): adhering the Dome reinforcing part with the material belt of the vibrating diaphragm by thermally curing the first thermosetting adhesive layer under high temperature and high pressure; and step (e): blanking the profile of the vibrating diaphragm using a blanking die cutter to form the vibrating diaphragm, wherein the material belt of the vibrating diaphragm forms the vibrating diaphragm body.

Preferably, in the step (a), further comprises step (a1): providing the fixing ring on the molding base for the vibrating diaphragm;

in the step (b), further comprises step (b1): providing the second thermosetting adhesive layer on the fixing ring; and in the step (d), the Dome reinforcing part and the material belt of the vibrating diaphragm are adhered together by thermally curing the first thermosetting adhesive layer, and the fixing ring and the material belt of the vibrating diaphragm are adhered together by thermally curing the second thermosetting adhesive layer under high temperature and high pressure, such that the fixing ring, the material belt of the vibrating diaphragm and the Dome reinforcing part are adhered as an integral structure to form the vibrating diaphragm.

Preferably, each of the first thermosetting adhesive layer and the second thermosetting adhesive layer employs a thermosetting adhesive pad.

Preferably, the fixing ring is a fixing ring made of metal material.

According to the technical solutions of the present invention, the advantageous effects of the present invention are described below.

The present invention provides a vibrating diaphragm and an assembling process for the vibrating diaphragm. The vibrating diaphragm body and the Dome reinforcing part are adhered together by thermally curing the first thermosetting adhesive layer utilizing high temperature and high pressure generated when molding the vibrating diaphragm. By adhering through the thermosetting adhesive layer, the adhesive strength between the vibrating diaphragm body and the Dome reinforcing part is greatly improved, and the reliability of the product is improved. At the same time, the hardness of the adhesive pad after adhering may be adjusted by choosing different thermosetting adhesive materials or process parameters as required, so as to achieve secondary hardening of the Dome reinforcing part and improve the rigidity of the Dome reinforcing part, thereby improving the rigidity of the finished vibrating diaphragm. When the vibrating diaphragm with such a configuration is applied to an electroacoustic product such as a speaker, it is possible to improve the rigidity of the vibrating diaphragm and reduce the transverse vibration of the vibrating diaphragm, thereby reducing the internal loss in the vibrating diaphragm, and improving the ability of radiating sound wave, the high-frequency characteristic of the product, the sound quality, and the acoustic performance of the product.

In the present invention, a fixing ring is provided on the fixing part, a second thermosetting adhesive layer is provided between the fixing part and the fixing ring, and the fixing part and the fixing ring are adhered together by thermally curing the second thermosetting adhesive layer. During the production process of the vibrating diaphragm with such a configuration, the vibrating diaphragm body and the Dome reinforcing part as well as the vibrating diaphragm body and the fixing ring are adhered together in the molding process of the vibrating diaphragm, by adhering the vibrating diaphragm body and the Dome reinforcing part together by thermally curing the first thermosetting adhesive layer, and adhering the vibrating diaphragm body and the fixing ring together by thermally curing the second thermosetting adhesive layer utilizing high temperature and high pressure generated when molding the vibrating diaphragm without individual process, thereby improving the production efficiency of the products.

BRIEF DESCRIPTION OF DRAWINGS

Hereinafter, the present invention will be further described with reference to the accompanying drawings and embodiments.

Figure 1:
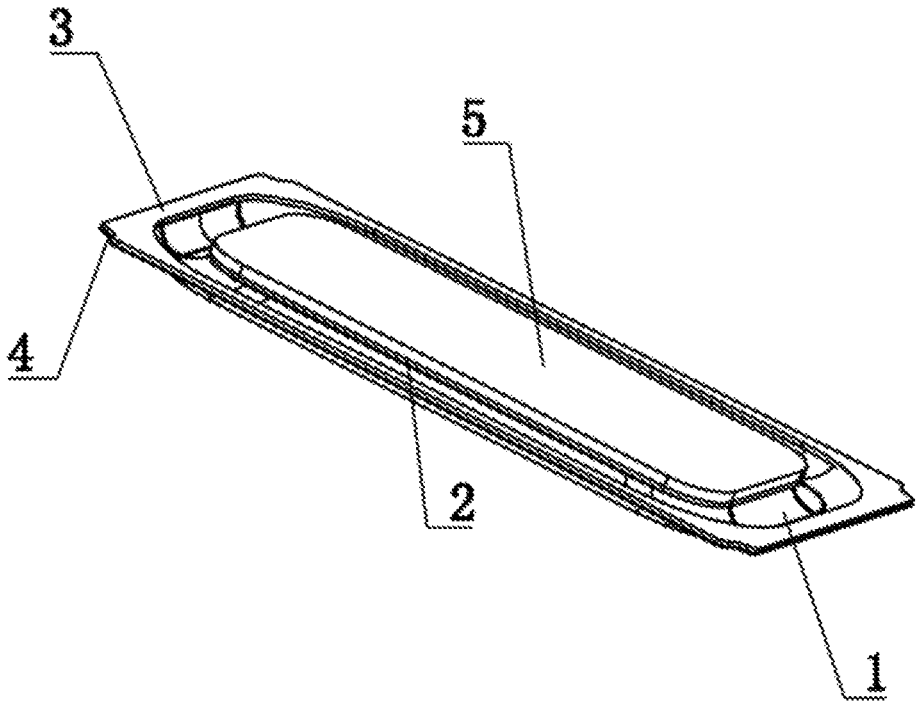
FIG. 1 is a schematic structural view of a vibrating diaphragm in the present invention.

In the drawings: 1, vibrating diaphragm body; 11, plane part; 12, fixing part; 2, first thermosetting adhesive pad; 3, fixing ring; 4, second thermosetting pad; 5, dome reinforcing part.

DETAILED DESCRIPTION OF EMBODIMENTS

The present invention is further described in detail with regard to accompanying drawings and embodiments in order to make the objectives, technical solutions and advantages of the present invention more clear. It will be understood that the described particular embodiments are only used for explaining the present invention, but not for limiting the present invention.

Figure 2:
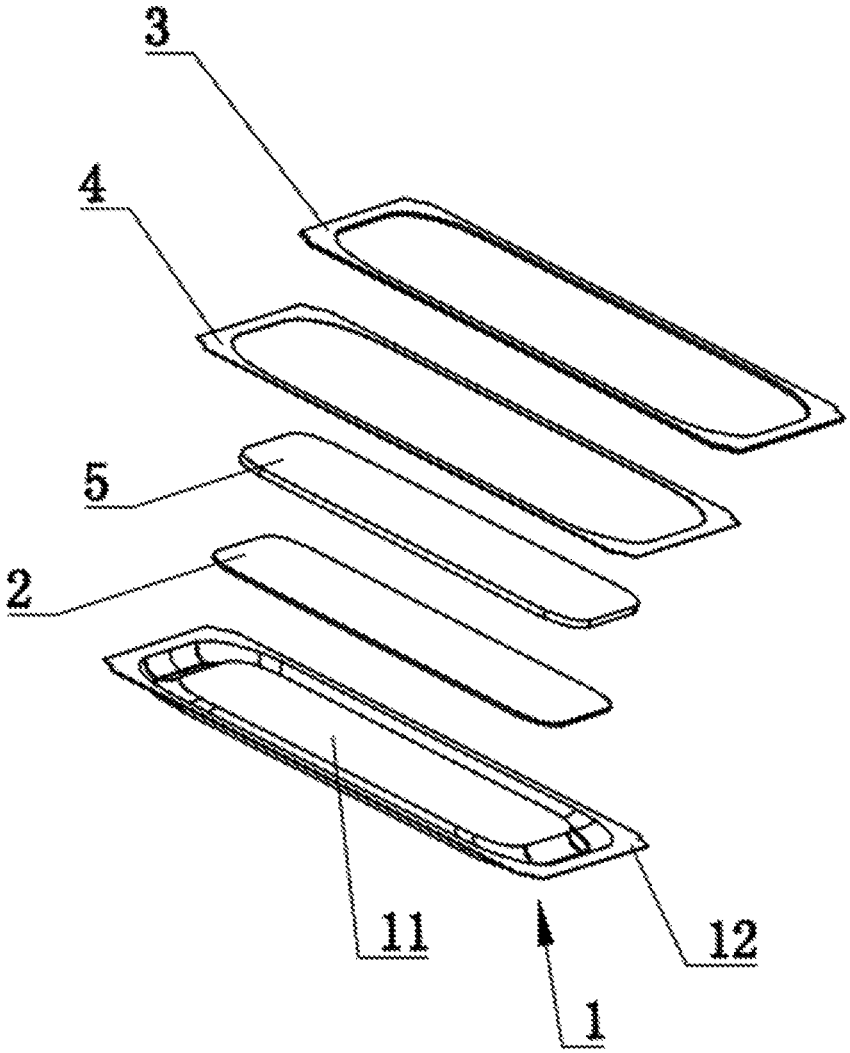
FIG. 2 is an exploded view of FIG. 1.
Figure 3:
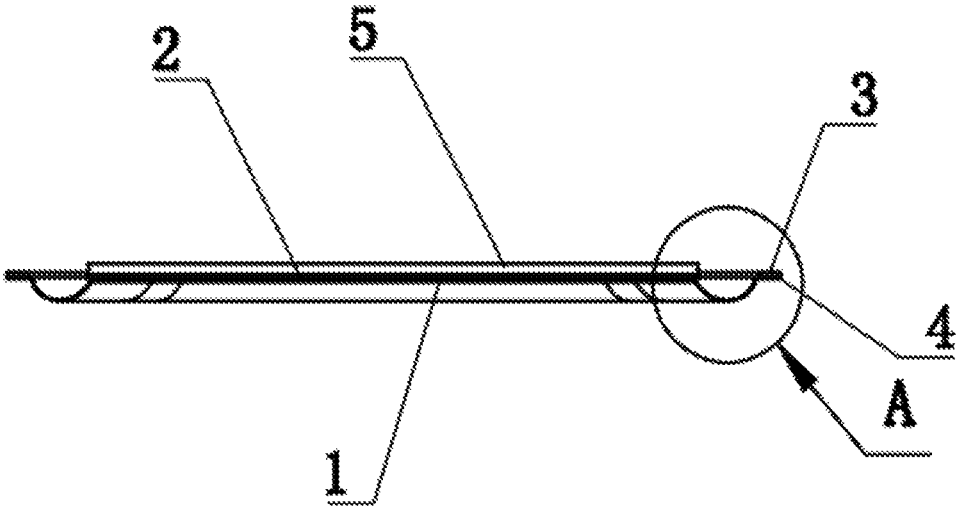
FIG. 3 is a front schematic structural view of FIG. 1.
Figure 4:
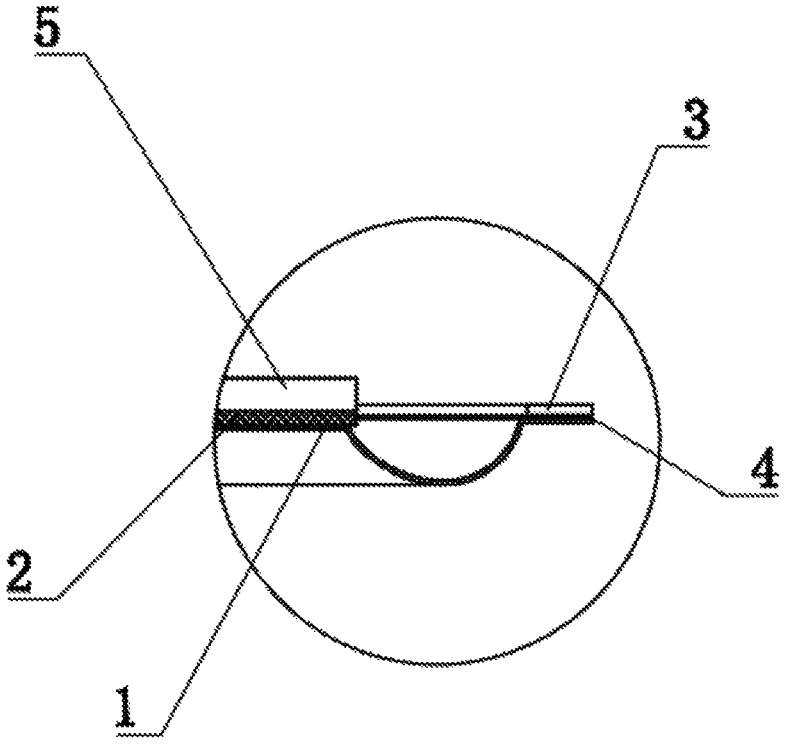
FIG. 4 is an enlarged schematic view of part A of FIG. 1.

Referring to FIGS. 1, 2, 3 and 4, a vibrating diaphragm comprises a vibrating diaphragm body 1. The vibrating diaphragm body 1 comprises a central plane part 11 and a peripheral fixing part 12. A Dome reinforcing part 5 for reinforcing rigidity is provided on the plane part 11. A fixing ring 3 for reinforcing strength is provided on the fixing part 12. A first thermosetting adhesive pad 2 is provided between the plane part 11 of the vibrating diaphragm body 1 and the Dome reinforcing part 5. The plane part 11 of the vibrating diaphragm body and the Dome reinforcing part 5 are adhered together by thermally curing the first thermosetting adhesive pad 2. A second thermosetting adhesive pad 4 is provided between the vibrating diaphragm body 1 and the fixing ring 3, and the fixing part 12 of the vibrating diaphragm body 1 and the fixing ring 3 are adhered together by thermally curing the second thermosetting adhesive pad 4.

Wherein, the first thermosetting adhesive pad 2 and the second thermosetting adhesive pad 4 may be replaced by sprinkling a layer of liquid thermosetting adhesive.

In the present embodiment, the thermosetting adhesive pad is made of epoxy resin material, and in the practical application, polyimide resin material or other material may be used as well.

In the present embodiment, the fixing ring 3 is a fixing ring made of steel material. However, a fixing ring made of other metal material may be used as well.

An assembling process for the above-mentioned vibrating diaphragm comprises the following steps:

step (a): preparing a molding base for the vibrating diaphragm, and providing the fixing ring 3 and the Dome reinforcing part 5 on the molding base for the vibrating diaphragm;

step (b): providing the first thermosetting adhesive pad 2 on the fixing ring 3, and providing the second thermosetting adhesive pad 4 on the Dome reinforcing part 5;

step (c): providing a material belt of the vibrating diaphragm above the fixing ring 3 and the Dome reinforcing part 5;

step (d): adhering the fixing ring 3 and the material belt of the vibrating diaphragm together by thermally curing the first thermosetting adhesive pad 2, and adhering the Dome reinforcing part 5 and the material belt of the vibrating diaphragm together by thermally curing the second thermosetting adhesive pad 4 utilizing high temperature and high pressure, such that the fixing ring 3, the material belt of the vibrating diaphragm and the Dome reinforcing part 5 are adhered as an integral structure; and step (e): blanking the profile of the vibrating diaphragm using a blanking die cutter to form the vibrating diaphragm, wherein the vibrating diaphragm body 1 is formed by the material belt of the vibrating diaphragm.

Wherein, the fixing ring 3 is a fixing ring made of steel material.

In the vibrating diaphragm and the assembling process for the vibrating diaphragm according to the present invention, during the production process, the vibrating diaphragm body 1 and the Dome reinforcing part 5 as well as the vibrating diaphragm body 1 and the fixing ring 3 are adhered together in the molding process of the vibrating diaphragm, by adhering the vibrating diaphragm body 1 and the Dome reinforcing part 5 together by thermally curing the first thermosetting adhesive pad 2, and adhering the vibrating diaphragm body 1 and the fixing ring 3 together by thermally curing the second thermosetting adhesive pad 4 utilizing high temperature and high pressure generated when molding the vibrating diaphragm without respectively adhering the vibrating diaphragm body 1 with the Dome reinforcing part 5 and the fixing ring 3, thereby improving the production efficiency of the products.

In addition, the vibrating diaphragm body 1 and the Dome reinforcing part 5, as well as the vibrating diaphragm body 1 and the fixing ring 3 are adhered together by thermally curing thermosetting adhesive pads, thereby greatly improving the adhesive strength between the vibrating diaphragm body 1 and the Dome reinforcing part 5, as well as the vibrating diaphragm body 1 and the fixing ring 3, and improving the reliability of the products. At the same time, the hardness of the adhered adhesive pads may be adjusted by choosing different thermosetting adhesive materials or process parameters as required, so as to achieve secondary hardening of the Dome reinforcing part 5 and improve the rigidity of the Dome reinforcing part 5, thereby improving the rigidity of the vibrating diaphragm. When the vibrating diaphragm with such a configuration is applied to an electroacoustic product such as a speaker, it is possible to improve the rigidity of the vibrating diaphragm and reduce the transverse vibration of the vibrating diaphragm, thereby reducing the internal loss in the vibrating diaphragm, and improving the ability of radiating sound wave, the high-frequency characteristic of the product, the sound quality, and the acoustic performance of the product.

The foregoing are examples of preferred embodiments of the present invention in which those not described in detail are well known to those skilled in the art. The scope of protection of the present invention is subject to the scope of the claims, and any equivalent transformation based on the technical enlightenment of the present invention also falls into the scope of the present invention.

What is claimed is:

1. A vibrating diaphragm comprising:

a vibrating diaphragm body comprising a plane part at central portion and a fixing part at a peripheral portion, wherein a Dome reinforcing part is provided on the plane part and a first thermosetting adhesive layer is provided between the plane part and the Dome reinforcing part, wherein the plane part and the Dome reinforcing part are adhered together by thermally curing the first thermosetting adhesive layer, and wherein a fixing ring is provided on the fixing part, a second thermostetting adhesive layer is provided between the fixing part and the fixing ring, and the fixing part and the fixing ring are adhered together by thermally curing the second thermosetting adhesive layer.

2. The vibrating diaphragm of claim 1, wherein each of the first thermosetting adhesive layer and the second thermosetting adhesive layer is a thermosetting adhesive pad.

3. The vibrating diaphragm of claim 2, wherein the thermosetting adhesive pad is a thermosetting adhesive pad made of one of a epoxy resin material and a polyimide resin material.

4. The vibrating diaphragm of claim 1, wherein the fixing ring is made of metallic material.

5. The vibrating diaphragm of claim 4, wherein the fixing ring is made of one of steel and copper.

6. An assembling process for the vibrating diaphragm of claim 1 comprising:

preparing a molding base for the vibrating diaphragm;

providing the Dome reinforcing part on the molding base for the vibrating diaphragm;

providing a fixing ring on the molding base for the vibrating diaphragm;

providing the first thermosetting adhesive layer on the Dome reinforcing part;

providing the second thermosetting adhesive layer on the fixing ring;

providing a material belt of the vibrating diaphragm above the Dome reinforcing part;

adhering the Dome reinforcing part with the material belt of the vibrating diaphragm by thermally curing the first thermosetting adhesive layer under high temperature and high pressure; wherein the Dome reinforcing part and the material belt of the vibrating diaphragm are adhered together by thermally curing the first thermosetting adhesive layer, and the fixing ring and material belt of the vibrating diaphragm are adhered together by thermally curing the second thermosetting adhesive layer under high temperature and high pressure, such that the fixing ring, the material belt of the vibrating diaphragm; and the Dome reinforcing part are adhered as an integral structure to form the vibrating diaphragm; and blanking a profile of the vibrating diaphragm using a blanking die cutter to form the vibrating diaphragm, wherein the material belt of the vibrating diaphragm forms the vibrating diaphragm body.

7. The assembling process of claim 6, wherein each of the first thermosetting adhesive layer and the second thermosetting adhesive layer is a thermosetting adhesive pad.

8. The assembling process of claim 6, wherein the fixing ring is a fixing ring is made of metallic material.

* * * * *